US005755386A

United States Patent [19]

Lavan et al.

[11] Patent Number: 5,755,386

[45] Date of Patent: May 26, 1998

[54] FUEL INJECTOR DEEP DRAWN VALVE GUIDE

[75] Inventors: Michael Brian Lavan, Rochester; Brent Jack Wahba, Honeoye Falls, both of N.Y.

[73] Assignee: General Motors Corporation, Detroit, Mich.

[21] Appl. No.: 578,853

[22] Filed: Dec. 26, 1995

[51] Int. Cl.[6] ..... B05B 1/30

[52] U.S. Cl. ..... 239/585.4; 239/585.1

[58] Field of Search ..... 239/533.2, 585.4, 239/585.1, 590, 585.5; 251/129.14, 129.21

[56] References Cited

U.S. PATENT DOCUMENTS

| | | | |
|---|---|---|---|
| 4,393,994 | 7/1983 | Rieck | 239/585 |
| 4,423,842 | 1/1984 | Palma | 239/585 |
| 4,423,843 | 1/1984 | Palma | 239/585 |
| 4,597,558 | 7/1986 | Hafner et al. | 239/585.1 |
| 4,621,772 | 11/1986 | Blythe et al. | 239/585 |
| 4,646,974 | 3/1987 | Sofianek et al. | 239/585 |
| 4,648,559 | 3/1987 | Fuller | 239/585 |
| 4,699,323 | 10/1987 | Rush et al. | 239/585 |
| 4,798,329 | 1/1989 | Mesenich | 239/585.1 X |
| 5,044,562 | 9/1991 | Rogers et al. | 239/543 |
| 5,344,081 | 9/1994 | Wakeman | 239/585.1 X |
| 5,381,963 | 1/1995 | Bright et al. | 239/533.2 |

FOREIGN PATENT DOCUMENTS

| | | |
|---|---|---|
| 3940585 | 6/1991 | Germany . |
| WO91/08393 | 6/1991 | WIPO . |

*Primary Examiner*—Andres Kashnikow
*Assistant Examiner*—Steven J. Ganey
*Attorney, Agent, or Firm*—Karl F. Barr, Jr.

[57] ABSTRACT

A fuel injector for discharging fuel to an internal combustion engine is disclosed. The injector has a nozzle body with an annular valve seat surrounding a fuel discharge opening. A valve member is disposed in the internal cylindrical cavity and is moveable between a first, sealing position relative to the valve seat and a second, open position off of the seat. The valve member is guided in its movement, with respect to the valve seat by a valve guide member disposed in the nozzle, closely adjacent the annular valve seat. The valve guide member includes a disc shaped member having an outer perimeter which is configured for placement within the nozzle body and a tubular central portion which defines a central, valve guide opening. The valve guide opening extends through the tubular central portion to open adjacent the annular valve seat and is configured for circumjacent disposition relative to the valve member to guide movement of the valve. Fuel openings extend through the valve guide and are disposed circumferentially about the valve guiding central opening to conduct fuel around the valve guide member.

1 Claim, 4 Drawing Sheets

FUEL INJECTOR DEEP DRAWN VALVE GUIDE

TECHNICAL FIELD

The invention relates to fuel injectors for delivery of fuel to the intake system of an internal combustion engine.

BACKGROUND

Proper control of the moving portion of a fuel injector valve improves spray quality and repeatability while reducing part-to-part spray variation, flow rate variation, and spray skew, which is the deviation of the fuel spray cone from the desired spray centerline. Guiding the valve as it opens and closes allows the fuel to pass uniformly through the opening in the injector valve seat rather than directing fuel flow to one side of the seat, as may be the case with an unguided valve. The resulting uniform flow through the valve seat opening leads to a uniform pressure zone across the upstream face of the injector's fuel director plate such that each fuel opening in the director plate flows an equivalent quantity of fuel. Additionally, because the fuel entering each of the fuel director's openings has the same flow vector, the spray vector of the fuel departing the openings is the same, resulting in a uniform spray pattern. In a fuel injector having an unguided valve member, the non-symmetrical flow pattern leads to a fuel momentum effect in which the fuel moves from one side of the valve to the opposite side of the director plate resulting in a non-uniform pressure zone across the upstream face of the director plate, spray skew and flow variation. Spray skew and flow variation impact intake port wall wetting, port-to-port wall wetting and fuel ratios which in turn impact engine emissions and transient response.

Fuel injector valves are typically guided using a cylindrical bore which is ground in to an associated valve seat. The sealing surface of the valve seat is conical and works, in conjunction with an associated valve, to regulate the flow of fuel through a valve opening in the seat. Valves may be ball shaped and typically include flat portions which are cut into the element to allow fuel to flow between the valve guide and valve when the valve is lifted from the seat. Shortcomings of this type of valve guidance include the additional cost of machining the flats on the valve element along with the added handling and machining steps which involve risk of error and damage during the forming process. The concentricity of the guide bore to the valve seat must be precise if valve leakage is to be avoided due to improper seating. Additionally the use of the flats on the valve element reduces the bearing area available on the valve as well as providing sharp edges on the valve guide surface, reducing durability of the injector. Finally, the fuel flow about the guide flats is not symmetric and can result in spray disruption even though the valve is guided in its movement.

SUMMARY

Accordingly it is an object of the present invention to provide a fuel injector, for use in an internal combustion engine, having a simple and precise means for centering and guiding the movement of a reciprocable valve relative to an associated valve seat.

A feature of the invention is to provide a lower guide element that provides the radial concentricity of the valve element with respect to the valve seat by guiding directly on the ball element without requiring modification of the valve member for fuel flow conveyance. Radially disposed fuel channels conduct fuel around the guiding interface. A uniform flow distribution is thus provided downstream of the valve guide resulting in superior flow characteristics.

The injector includes a nozzle body having a fuel opening disposed at its closed end, surrounded by an annular valve seat. A valve guide is located in the nozzle body adjacent the valve seat. The valve guide is constructed of flat, sheet stock which is partially drawn into a tubular configuration about a central, funnel shaped valve guiding opening. The tubular portion extends downstream and terminates with an internal diameter configured to closely guide a moveable valve member through close, circumjacent contact therewith. The downward, tubular extension, in the direction of the nozzle body valve seat, allows the use of an optimally sized valve element. Fuel openings extend through the valve guide and are disposed circumferentially about the perimeter of the valve guiding opening. The circumferential placement of the fuel openings, relative to the valve member provide for the desired, uniform delivery of fuel to the valve seat and its associated fuel opening.

The drawing process used in the construction of the valve guide member results in work-hardening of the surface of the funnel shaped valve guiding opening. Such work hardening of the valve guide may dispense with secondary operations such as ballizing or burnishing to achieve desired surface hardness.

The valve guide may be assembled into the nozzle body by locating the guide in the closed end of the nozzle body, adjacent the valve seat. The valve guide is preferably located using a gage ball to precisely align the guide opening with the sealing surface of the valve seat thereby eliminating concerns of angularity between the axis of the valve guide opening and that of the valve seating surface, which could operate to impact guiding and sealing functions.

Embodiments of the present invention are described below, by way of example only, with reference to the accompanying drawings.

DESCRIPTION OF THE PREFERRED EMBODIMENT

Figure 1:
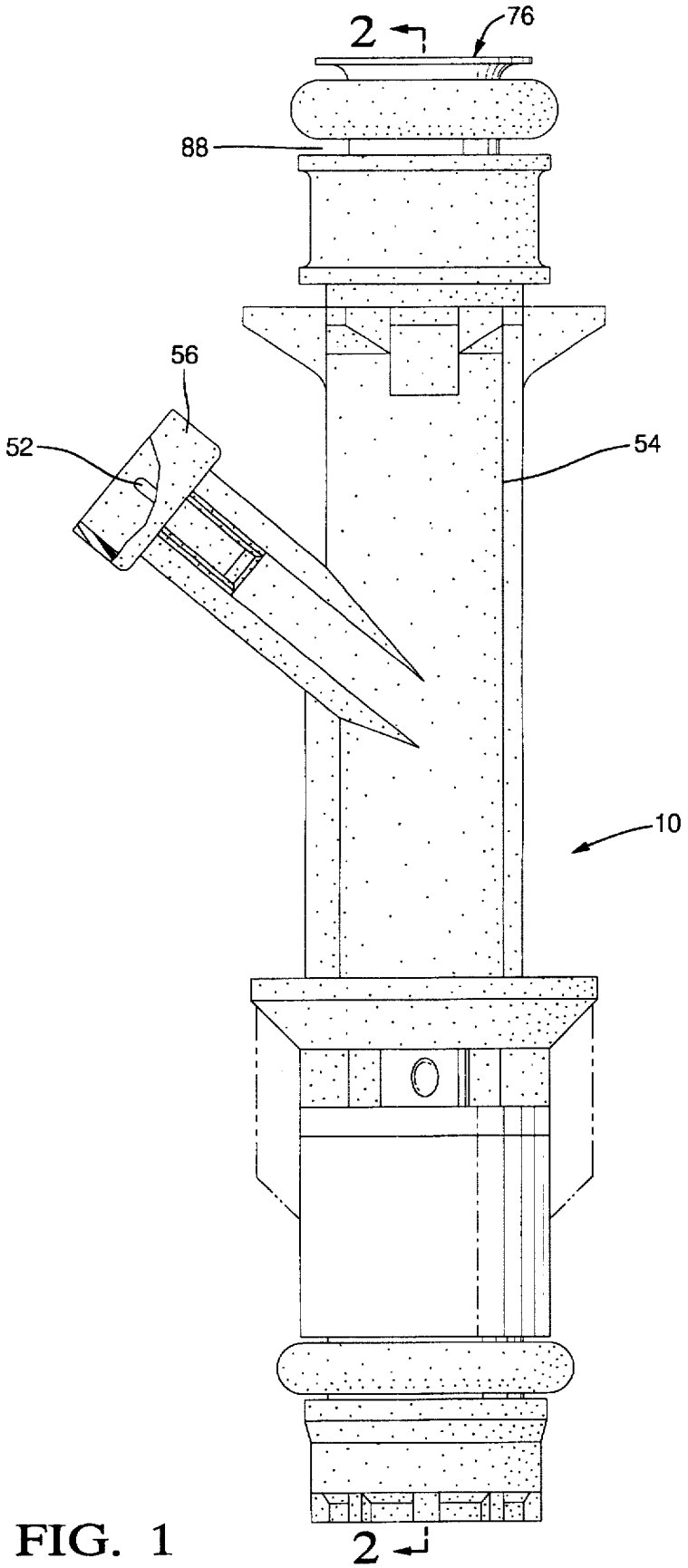
FIG. 1 is a side view of a fuel injector embodying features of the present invention.
Figure 2:
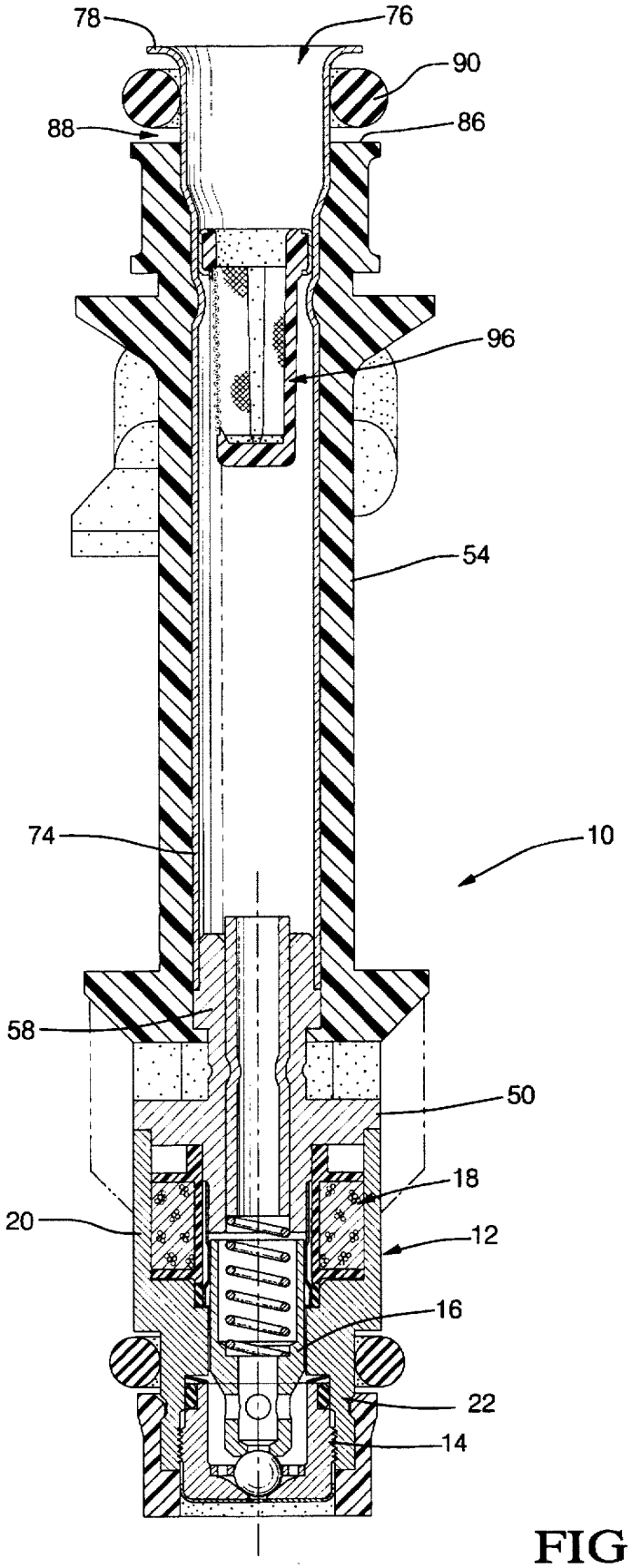
FIG. 2 is a sectional view of the fuel injector of FIG. 1 taken along line 2—2 of FIG. 1.
Figure 3:
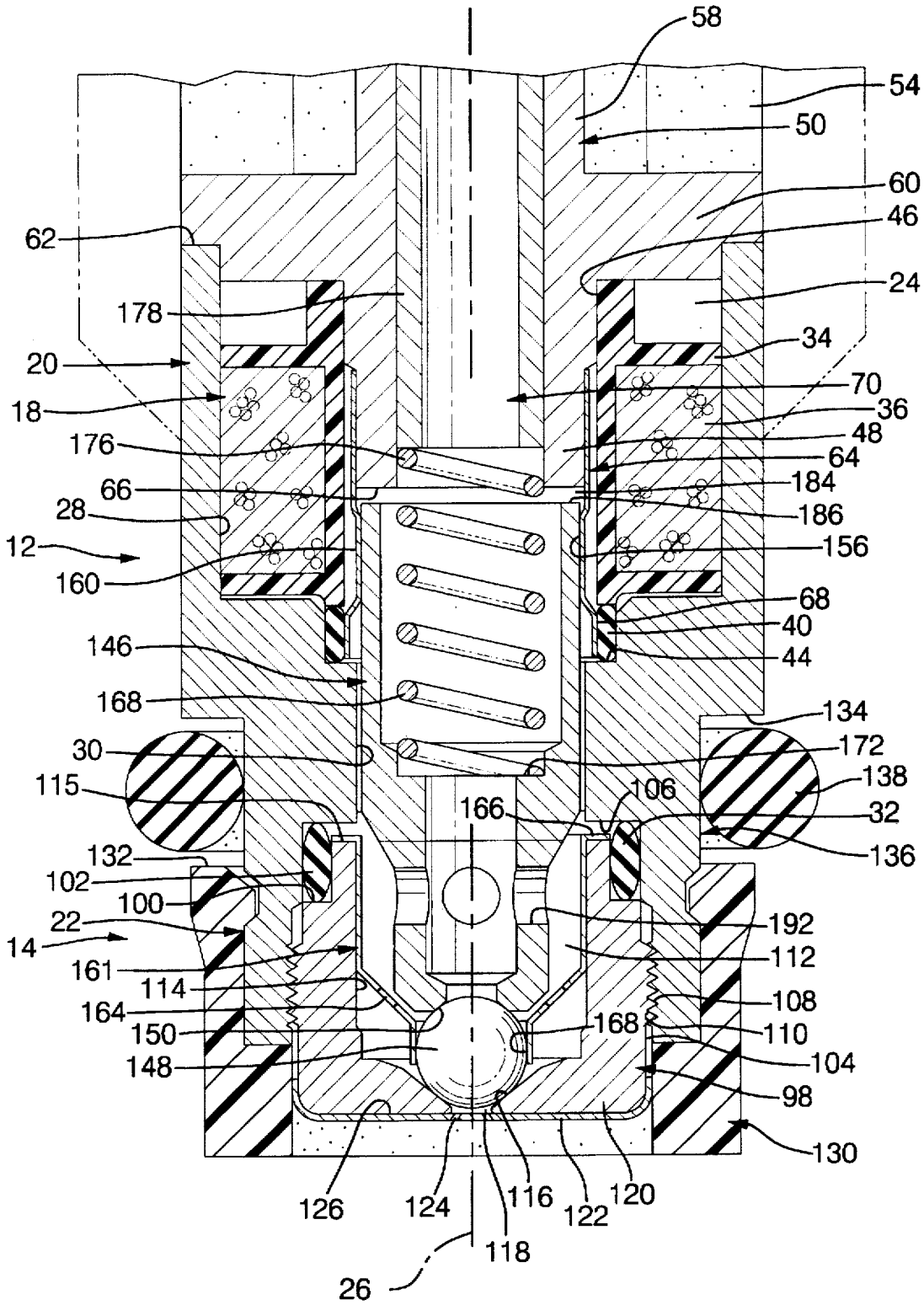
FIG. 3 is an enlarged cross section of a portion of FIG. 2.

Referring to FIGS. 1–3, an electromagnetic fuel injector, designated generally as 10, includes as major components thereof a body 12, a nozzle assembly 14, a valve member 16 and a solenoid assembly 18 used to control the movement of the valve member 16.

In the construction illustrated, the body 12 is of cylindrical, hollow tubular configuration and is of such external shape as to permit direct insertion, if desired, of the injector 10 into a socket provided for this purpose in an engine intake manifold, not shown.

The body 12 includes an enlarged upper solenoid case portion 20 and a lower end, nozzle case portion 22 of reduced internal and external diameter relative to the solenoid portion 20. An internal cylindrical cavity 24 is formed in the body 12 by a stepped bore therethrough that is substantially coaxial with the axis 26 of the body. In the construction shown, the cavity 24 includes a cylindrical upper wall 28, a cylindrical intermediate wall 30 and a cylindrical lower wall 32. Wall 30 is of a reduced diameter relative to upper and lower wall portions 28 and 32, respectively.

Solenoid assembly 18 is disposed within the enlarged upper solenoid case portion 20 and includes a spool-like, tubular bobbin 34 supporting a wound wire solenoid coil 36. A resilient sealing member such as o-ring 40 is disposed between the tubular bobbin 34 and a seal shoulder 44 in the cylindrical intermediate wall 30. The bobbin 34 is provided with a central through bore 46 configured to encircle the lower, reduced diameter portion 48 of pole piece 50. A pair of terminal leads 52 are operatively connected at one end to the solenoid coil 36 and each such lead has its second end extending upwardly through an outer, overmolded casing 54, to terminate in a terminal socket 56, for connection of the fuel injector to a suitable source of electrical power in a manner well known in the art.

Pole piece 50 includes an upper cylindrical portion 58, a centrally located circular, radial flange portion 60 and the lower reduced diameter cylindrical pole 48. The circular, radial flange portion 60 is slidably received at its outer peripheral edge within the cylindrical upper wall 28 of the body 12 to thereby close the enlarged upper solenoid case portion 20 of the body 12 and retain the solenoid assembly 18 therein. The pole piece 50 is axially retained within the upper cylindrical portion of the body 12 by welding or otherwise suitably bonding its flange portion 60 to the shoulder 62 along the upper, opened end of wall 28.

Formed integral with the pole piece 50 and extending downwardly from the flanged portion 60 is the lower cylindrical pole 48. Pole 48 is of a suitable exterior diameter so as to be slidably received in the central through bore 46 that extends coaxially through the coil bobbin 34. Received about the lower end of the lower cylindrical pole 48 of the pole piece 50 is a cylindrical tube 64 of non-magnetic material such as stamped or drawn metal. The tube may be welded or bonded or otherwise sealed to the lower pole piece 48 so as to prevent fuel penetration of the joint between the tube 64 and the pole. The tube 64 extends axially downwardly beyond the lower end, working surface 66 of the lower cylindrical pole 48. The outer surface 68 of the extended portion of the tube 64 acts as an interface with resilient sealing member 40, operating to seal the central, fuel passage 70 of the fuel injector 10 from solenoid assembly 18.

The upwardly extending cylindrical boss 58, of pole piece 50, is configured to receive an axially upwardly extending, deep drawn fuel inlet tube 74. The inlet tube has a first inlet end 76 having a flanged end portion 78. The fuel inlet tube 74 is fixed to the pole piece 50 and encased by overmolded upper housing 54, which is formed of a suitable encapsulant material and, as described above, also includes an integral terminal socket 56 with leads 52. An upper seal shoulder 86 formed in the overmolded housing 54 is axially spaced from the tube flange 78 to define an annular seal groove 88 configured to carry a resilient sealing member such as o-ring 90 for leak free attachment to a source of pressurized fuel, not shown. Within the fuel inlet tube 74, the injector fuel filter assembly 96 traps fuel contaminants.

The nozzle assembly 14 includes a nozzle body 98 having a cup-shaped, tubular configuration with a stepped upper shoulder 100 configured to receive a sealing member such as o-ring 102. The sealing member 102 is disposed between the shoulder 100 on the outer surface of the nozzle body 98 and, the shoulder 106 which extends between the intermediate wall 30 and the lower wall 32 of the lower end nozzle case portion 22 of the body 12, thereby establishing a seal against leakage at the interface of the nozzle assembly 14 and the body 12. The nozzle body 98 includes a series of external threads 108 which engage corresponding internal threads 110 in the lower wall 32 of the body 12 providing axial adjustability of the nozzle body within the injector body. An internal cylindrical cavity 112 in the nozzle body 98 is defined by an inner cylindrical wall 114 which extends from the open, upper end of the nozzle body to terminate in an annular, frustoconical valve seat 116 disposed about an axially aligned, fuel discharge opening 118 at the lower end thereof. The cylindrical cavity 112 operates as a fuel supply repository within the nozzle assembly 14.

Over the exterior of the lower end 120 of the nozzle body 98 is placed a fuel spray director plate 122. Fuel passing through the fuel discharge opening 118 in the valve seat 116 is delivered to the upstream side, or face 126 of the director plate 122 where it is distributed across the face to fuel openings 124. The openings 124 are oriented in a predetermined configuration which will generate, in the discharged fuel, a desired spray configuration.

A cylindrical retainer sleeve 130 is also engaged over the lower end 120 of nozzle body 98. The retainer includes an upper annular shoulder 132 which defines, with shoulder 134 of body 12, an annular groove 136 for the placement of resilient sealing member 138. The cylindrical retainer sleeve 130 is preferably constructed of a durable, temperature resistant plastic such as nylon and is snapped over the lower end, nozzle case portion 22 of the body 12.

Referring now to the valve member 16, it includes a tubular armature 146 and a valve element 148, the latter being made of, for example, a spherical ball having a predetermined radius, which is welded to the lower annular end 150 of the tubular armature 146. The radius of the valve element 148 is chosen for seating engagement with the valve seat 116. The tubular armature 146 is formed with a predetermined outside diameter so as to be loosely slidable within the non-magnetic cylindrical tube 64 received about and extending from the lower pole piece 48. The tube 64 extends coaxially with the axis 26 of the injector 10 along which the valve member 16 is centered. An armature bearing 156 extends radially inwardly to contact the outer surface of the tubular armature 146 in a circumjacent relationship therewith. The armature bearing 156 may be defined by a reduced diameter portion 160 of tube 64.

Figure 4:
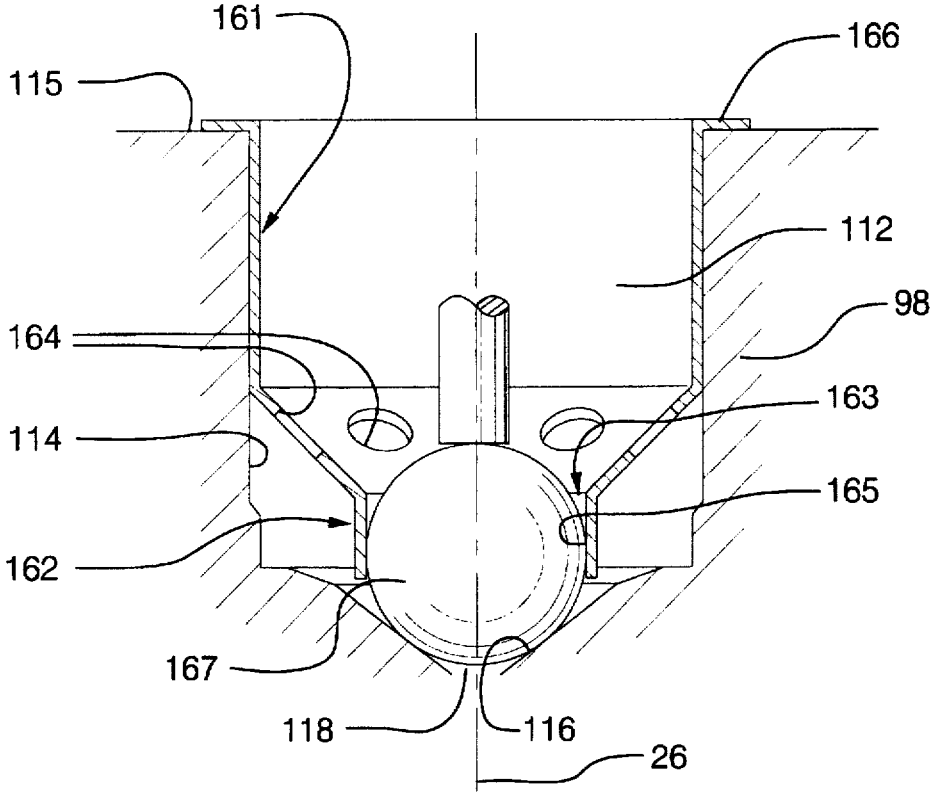
FIG. 4 is a schematic sectional view of the valve guide member of the present invention.
Figure 5:
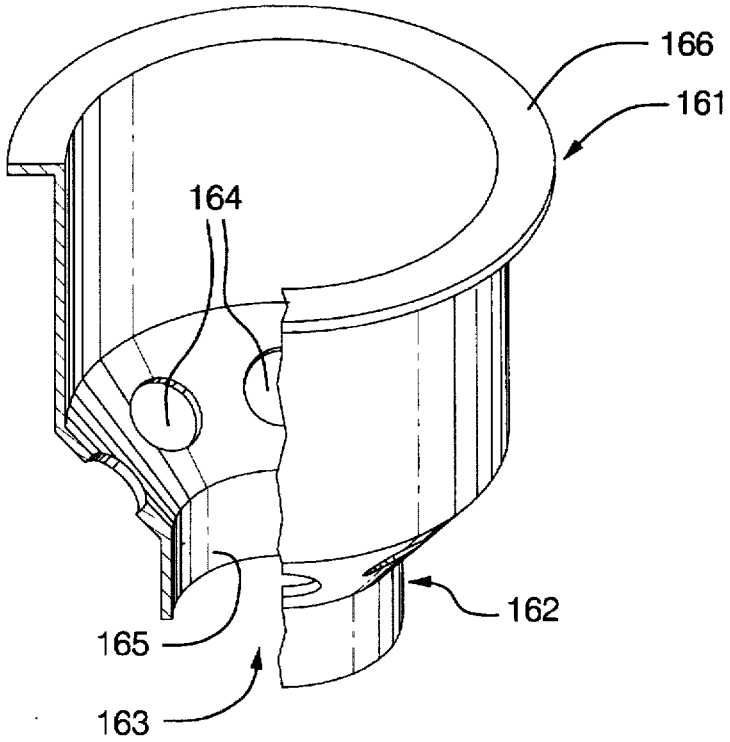
FIG. 5 is a perspective view, partially in section of the valve guide member of the present invention.

Positioned within the cylindrical cavity 112 of the nozzle body 98, adjacent the valve seat 116, is a valve guide member 161. The valve guide member 161, shown in detail in FIGS. 4 and 5, is constructed using flat sheet stock having a disc shaped outer perimeter 166, configured to seat on shoulder 115 disposed at the upstream end of inner cylindrical wall 114 of nozzle body 98. The sheet stock is drawn into a tubular central guide feature 162 with a centrally located valve guide opening 163 extending therethrough. The opening 163 is centered along injector axis 26 when installed in the nozzle body 98 and includes a diameter configured only minimally larger than the outer diameter of the valve element 148 of valve member 16. Fuel openings 164 extend through the valve guide 161 to provide conduits for fuel to move freely from the fuel collecting internal cylindrical cavity 112 to the valve seat 116. In a preferred embodiment of the invention, the openings are positioned at circumferentially spaced locations about the central, valve guide opening 163. The circumferential placement of the fuel openings 164, relative to the valve element 148 and the valve seat 116, provide a uniform flow of fuel to the valve seat that balances the fluid pressure distribution below the valve element. Such fuel balance is desirable as the fuel passes through the fuel opening 118 and is delivered to the upstream side 126 of the fuel director plate 122, as it improves the consistency of fuel flow through the fuel directing openings 124 in the director plate 122.

The valve guide member 161 eliminates significant manufacturing steps in its construction. The circumferential fuel openings 164 can be punched during stamping or drawing of the tubular central guide feature 162. In addition, the drawing function used to form the guide feature 162 simultaneously operates to harden the guiding surface 165 which may eliminate the need for heat treating the guide member.

The valve guide 161 is assembled into the nozzle body 98 by locating the guide within the cylindrical fuel cavity 112 with the tubular central guide feature 162 of the guide terminating closely adjacent the valve seat 116. As shown in FIG. 4, when installed in the nozzle body 98, the valve guide annular flange 166 abuts, and is axially supported by the shoulder 115 of the nozzle body inner wall 114 with the valve guide central opening 163 sharing a common axis 26 with the nozzle body. During installation of the valve guide member 161 into the nozzle body 98, tooling which includes a gage ball 167, shown schematically in FIG. 4, is inserted into, and partially through the central valve guide opening 163 to seat against annular valve seat 116, thereby aligning the guide 161 with the valve seat 116. Use of a gage ball 167 to align the components minimizes concentricity errors between the valve seat 116 and the guide opening 163. Following alignment of the valve guide member 161 with the valve seat 116, the disc shaped portion or flange 166 of the valve member 161 is welded to shoulder 115 thereby fixing the guide within the nozzle body 98. While welding of the valve guide to the nozzle body is preferred as a method for fixing the guide within the injector, other means for bonding may be chosen.

The armature bearing 156 in tube 64 and the valve guide member 161 cooperate to control the movement of the valve member 16, in the longitudinal direction, within the injector 10. The valve member element 148 of valve member 16 is normally biased into a closed, seated engagement with the valve seat 116 by a biasing member such as valve return spring 168 of predetermined spring force which is inserted into the upstream end of the tubular armature 146.

The first end of the spring 168 seats against shoulder 172 which is located intermediate the ends of the armature tube while the second end of the spring 168 seats against the lower end 176 of calibration sleeve 178 inserted into the central, through bore 46 of pole piece 50. The calibration sleeve is moved axially towards the valve seat 116 to increase the spring preload exerted on the valve member 16 in the direction of the valve seat. Withdrawal of the calibration sleeve 178 lessens the spring preload on the valve member 16. The calibration sleeve 178 is fixed in position within the pole piece 50 when the desired spring preload is achieved.

A working air gap 184 is defined between the working surface 186 at the upper end of armature tube 146 of the valve member 16 and the working surface 66 at the lower end of the pole piece 50. Upon energization of the solenoid assembly 18, the tubular armature 146 and associated valve element 148 is drawn upwardly and off of the valve seat 116 against the bias of the spring member 168 to close the working air gap 184. Fuel flows from the pressurized source into the first, inlet end 76 of the fuel inlet tube 74, flows the length of the tube 74 and enters the body 12 through the pole piece 50. Fuel flows through the tubular armature 146 and into the fuel chamber 112 in nozzle body 98 through circumferentially spaced openings 192 in the second end of the armature tube 146. As described above, the fuel passes through the openings 164 in the valve guide 161 and exits the valve body 98 through the opening 118 in valve seat 116.

Fuel exiting the valve seat 116 is distributed onto the upstream side 126 of the fuel director plate 122 where it is distributed to the fuel director orifices 124 passing through the plate, for discharge from the fuel injector 10. Deenergization of the solenoid assembly 18 allows the field within the magnetic circuit defined by the pole piece 50, the body 12, and the armature 146 to collapse thereby allowing the valve member return to the closed position against the valve seat 116 under the bias of the spring member 168 to stop the flow of fuel therethrough.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A fuel injector for discharging fuel to an internal combustion engine comprising a cup shaped nozzle body having an internal cylindrical cavity defined by a cylindrical wall extending from an open, upper end of the nozzle body to terminate in an annular valve seat surrounding a fuel discharge opening, said fuel injector further comprising a valve member including an axially extending tubular armature and a spherical valve element disposed, for reciprocal movement, in said internal cylindrical cavity and moveable between a first, sealing position against said annular valve seat and a second, open position off of said annular valve seat, said valve member guided in its movement, relative to said valve seat, by a valve guide member disposed in said cylindrical cavity adjacent said annular valve seat, said valve guide member constructed of flat sheet stock and including an annular flange portion including a disc shaped outer perimeter configured to engage a shoulder portion extending about said open, upper end of the nozzle body for support of said guide member therein, an axially extending tubular central portion depending from said annular flange portion and extending axially downwardly and below said annular flange portion towards said valve seat to define at its terminus a central, valve guide opening spaced axially from said annular flange portion and configured for circumjacent disposition about said spherical valve element, said central valve guide opening operable to guide said reciprocal movement of said spherical valve element relative to said valve seat, and fuel openings extending through said axially extending tubular central portion, axially intermediate of said annular flange portion and said central valve guide opening, to conduct fuel from said internal cylindrical cavity through said valve guide member and to said valve seat.

* * * * *